US009875861B2

(12) United States Patent
Ergin et al.

(10) Patent No.: US 9,875,861 B2
(45) Date of Patent: Jan. 23, 2018

(54) DEVICE AND METHOD FOR SWITCHING A DIRECT CURRENT

(71) Applicant: SIEMENS AKTIENGESELLSCHAFT, Munich (DE)

(72) Inventors: Dominik Ergin, Baiersdorf (DE); Hans-Joachim Knaak, Erlangen (DE); Mojtaba Mohaddes Khorassani, Winnipeg (CA)

(73) Assignee: Siemens Aktiengesellschaft, Munich (DE)

( * ) Notice: Subject to any disclaimer, the term of this patent is extended or adjusted under 35 U.S.C. 154(b) by 53 days.

(21) Appl. No.: 15/100,389

(22) PCT Filed: Nov. 29, 2013

(86) PCT No.: PCT/EP2013/075144

§ 371 (c)(1),
(2) Date: May 31, 2016

(87) PCT Pub. No.: WO2015/078525

PCT Pub. Date: Jun. 4, 2015

(65) Prior Publication Data

US 2016/0300671 A1 Oct. 13, 2016

(51) Int. Cl.
*H01H 9/54* (2006.01)
*H01H 33/59* (2006.01)

(52) U.S. Cl.
CPC ..... *H01H 9/548* (2013.01); *H01H 33/596* (2013.01)

(58) Field of Classification Search
CPC ..... H01H 9/548; H01H 33/596
See application file for complete search history.

(56) References Cited

U.S. PATENT DOCUMENTS

| | | | | |
|---|---|---|---|---|
| 5,666,257 | A | 9/1997 | Yang | |
| 5,764,459 | A | 6/1998 | Yang | |
| 2012/0299393 | A1 | 11/2012 | Häfner et al. | |
| 2013/0070492 | A1 * | 3/2013 | Skarby | H01H 33/596 363/51 |

(Continued)

FOREIGN PATENT DOCUMENTS

| | | | |
|---|---|---|---|
| CN | 101814727 | A | 8/2010 |
| CN | 102687221 | A | 9/2012 |

(Continued)

*Primary Examiner* — Jared Fureman
*Assistant Examiner* — Joel Barnett
(74) *Attorney, Agent, or Firm* — Laurence Greenberg; Werner Stemer; Ralph Locher

(57) ABSTRACT

A device switches a direct current. The device contains an operating current branch in which a mechanical switch is arranged, a protective switch connected to the operating current branch for interrupting the current flow in the operating current branch, a capacitor branch connected in parallel with the operating current branch in which capacitor branch a capacitor is arranged, and a damping apparatus which has a resistance element. The damping apparatus is arranged in the capacitor branch in series with the capacitor or in the operating current branch in series with the mechanical switch, which damping apparatus can be bypassed by a bypass switch connected in parallel with the damping apparatus.

11 Claims, 1 Drawing Sheet

(56) References Cited

U.S. PATENT DOCUMENTS

| | | | | |
|---|---|---|---|---|
| 2013/0278078 | A1 | 10/2013 | Ohlsson et al. | |
| 2015/0002977 | A1 | 1/2015 | Dupraz et al. | |
| 2015/0022928 | A1* | 1/2015 | Mohaddes Khorassani | H02H 3/087 361/93.7 |
| 2015/0131189 | A1* | 5/2015 | Davidson | H01H 9/542 361/91.5 |
| 2015/0333496 | A1* | 11/2015 | Ergin | H01H 9/542 361/101 |

FOREIGN PATENT DOCUMENTS

| | | | |
|---|---|---|---|
| CN | 102971819 | A | 3/2013 |
| CN | 103325591 | A | 9/2013 |
| CN | 103370760 | A | 10/2013 |
| WO | 2013092873 | A1 | 6/2013 |
| WO | 2013093066 | A1 | 6/2013 |

* cited by examiner

DEVICE AND METHOD FOR SWITCHING A DIRECT CURRENT

BACKGROUND OF THE INVENTION

Field of the Invention

The present invention relates to a device for switching a direct current. The device comprises an operating current branch in which a mechanical switch is arranged, a protective switch connected to the operating current branch for interrupting the current flow in the operating current branch, a capacitor branch arranged in parallel with the operating current branch, in which a capacitor is arranged, and an attenuator which includes a resistance element.

Switching devices of such kind are generally connected to an electrical DC-voltage line or a DC voltage network and are used to interrupt the line carrying direct current in the event of a fault. During normal operation of the device, the mechanical switch and the protective switch are closed, so that the operating current flows via the operating current branch. In the event of a short circuit, the short-circuit current is commutated to the capacitor branch, in which case the capacitor is charged. A reverse voltage is thus built up which causes the device to become current less.

The device initially specified is thus disclosed, for example, in WO 2013/093066 A1. The attenuator according to WO 2013/093066 A1 is arranged in parallel with the operating current branch and is provided to enable a reactivation of the device within a brief period, following a deactivation in the event of a fault.

In the known device, an additional switching element is in series with the attenuator. After a fault occurs, the switching element may be closed in the case of an open protective switch as well as an open mechanical switch, so that the capacitor is able to discharge via the attenuator. In this way, a rapid reconnection of the device is made possible. However, in the known device, the same voltage dimensioning is necessary for the additional switching element as for the protective switch which is to switch the current in the operating current branch. This results in increased costs for the additional switching element.

BRIEF SUMMARY OF THE INVENTION

The object of the present invention is therefore to provide a device of the kind initially specified which is economical.

The object is achieved in that the attenuator in the capacitor branch is arranged in series with the capacitor, or in the operating current branch in series with the mechanical switch, wherein the attenuator is bridgeable by means of a bridging switch arranged in parallel with the attenuator.

During normal operation, the bridging switch is closed. If a fault occurs, the capacitor in the capacitor branch may thus be charged until the current falls to zero due to the built-up reverse voltage. In the case of an open protective switch and an open mechanical switch, the bridging switch may be opened, so that the capacitor is able to be discharged via the attenuator as soon as the mechanical switch is closed again.

The device according to the present invention has the advantage that the dimensioning of the dielectric strength of the bridging switch may be reduced. The reason for this is that after the capacitor is charged and the protective switch is opened, the total capacitor voltage drops only transiently across the bridging switch alone. In this way, the overall cost of the device may be reduced, since the bridging switch does not have to be designed for a continuous voltage at the level of the maximum capacitor voltage, but rather only for a pulse load during the discharge process.

In order to ensure the function of reconnecting the device after a brief interruption, the resistance element of the attenuator must be designed corresponding to the energy possibly stored in the capacitor. Since an inductance may also be associated with any resistance element in addition to a resistance value, these two values must meet predetermined requirements for the desired period of time between the deactivation and the reactivation. Preferably, the resistance element has an electrical resistance and an inductance whose values allow a discharge of the fully charged capacitor via the attenuator within a period of time from 50 ms to 500 ms, particularly preferably, from 100 ms to 250 ms.

For example, it may prove to be advantageous if the attenuator includes a separate inductor element. In this case, the inductor element forms a parallel circuit with the resistance element. The attenuator formed in such a way thus limits the peak value of the discharge current and absorbs the energy stored in the capacitor particularly effectively.

According to one specific embodiment of the present invention, the device furthermore includes a varistor, for example, a metal-oxide varistor, which is connected in parallel with the capacitor and with the operating current branch. By means of the varistor, a limiting voltage may be defined which may be built up to a maximum extent during the charging of the capacitor. The varistor must be designed in such a way that the limiting voltage is greater than a network voltage of the DC voltage network to which the device is connected.

According to an additional specific embodiment of the present invention, the device furthermore includes a power semiconductor switch which is arranged in series with the mechanical switch in the operating current branch. In the event of a short circuit, the current in the operating current branch initially increases approximately linearly. The power semiconductor switch is configured to switch off in such a case with a time delay which is as small as possible, preferably in the microsecond range, so that the further increasing current in the capacitor branch is commutated. Simultaneously, the opening of the mechanical switch is initiated. The mechanical switch is then opened so that the power semiconductor switch is not damaged by the high voltage which is present (of up to several hundred kilovolts). Depending on the design of the power semiconductor switch, the device may be designed as a unidirectional or bidirectional switch. By using the electronic power switch, it furthermore advantageously results that the mechanical switch may be opened without current (so that it is possible to prevent arc formation), and that the mechanical switch does not have to provide the necessary commutation voltage.

Preferably, the capacitor arranged in the capacitor branch has a capacitance value which is between 25 μF and 200 μF.

According to one specific embodiment of the present invention, the bridging switch is a mechanical circuit breaker. The mechanical circuit breaker uses, for example, an electromagnetic action of force for opening and closing its contacts. However, it is also conceivable that the bridging switch is a power switch, for example, a conventional AC voltage switch. The bridging switch may always be switched in a currentless state of the device. The requirements for the switching time of the bridging switch are therefore in the normal range of the AC voltage technology, preferably in the range of less than 100 ms.

In addition to the previously described function, if the bridging switch is arranged in the operating current branch, it is possible by means of the device to pre charge a line, for example, a cable, for example, following the device, via the attenuator. For this purpose, before energizing the line, the bridging switch is opened by means of the protective switch. Any charging current thus flows via the attenuator, so that a peak value and the load for all components in the network are reduced. As soon as the current is reduced to a predetermined value, the bridging switch may be closed and normal operation may be started.

If the bridging switch is arranged in the operating current branch, an additional advantage of the device may be seen in the fact that if a fault current from the operating current branch to the capacitor branch is to be commutated in the event of a fault, the mechanical switch and the bridging switch may be opened immediately if necessary. As a result, an arc voltage is available to the two switches from the beginning as a commutation voltage. In this case, both switches are suitably very fast switches which have an arc-carrying capacity.

Furthermore, the present invention relates to a method for switching the direct current by means of the appropriate device.

Based on the related art, the object of the present invention is to provide an alternative method for switching the direct current by means of the appropriate device.

The object is achieved via the method in which, in the event of a fault, after opening the protective switch, the bridging switch is opened and the capacitor is discharged via the operating current branch and the attenuator.

According to one advantageous specific embodiment of the method, the bridging switch is closed only after discharging the capacitor and after closing the protective switch. If the bridging switch is arranged in the operating current branch, after energizing the device by closing the protective switch, the current thus initially flows for a limited time via the attenuator. As a result, the peak current value and thus the loading of one of the components downstream from the device may be reduced. For starting normal operation, the bridging switch is closed again after a predetermined time.

BRIEF DESCRIPTION OF THE SEVERAL VIEWS OF THE DRAWING

Exemplary embodiments of the present invention are described in greater detail below based on FIGS. 1 and 2.

DESCRIPTION OF THE INVENTION

Figure 1:
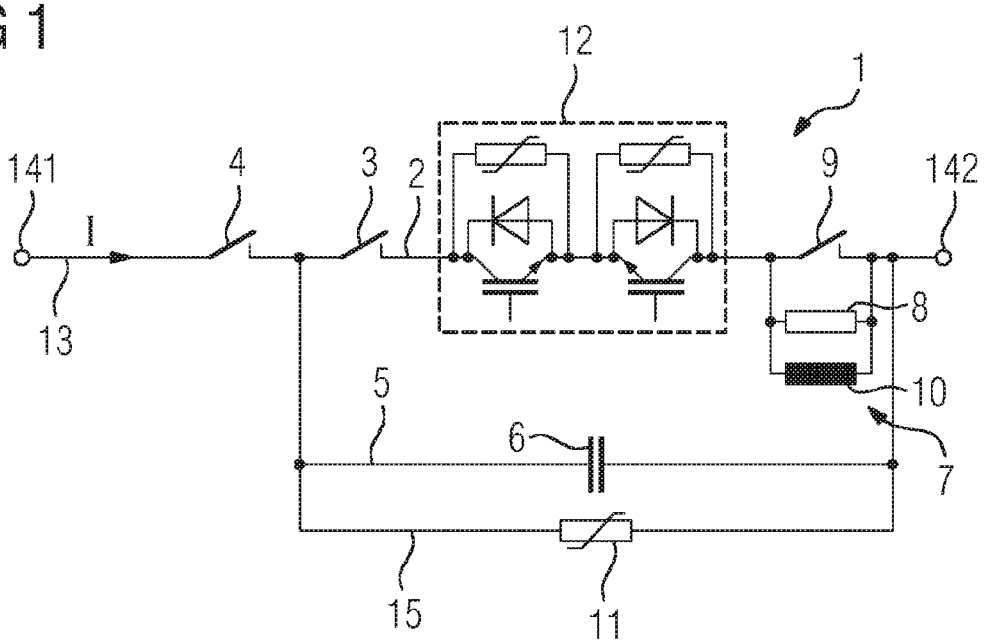
FIG. 1 shows a schematic representation of a first exemplary embodiment of a device according to the present invention.

FIG. 1 depicts in detail a first exemplary embodiment of the device 1 according to the present invention for switching a DC current. The device 1 has two terminals 141, 142, by means of which the device 1 is connected to a DC voltage network. The current direction is indicated by the arrow 13. The device 1 includes an operating current branch 2 and a capacitor branch 5, wherein the capacitor branch 5 is connected in parallel with the operating current branch 2. Furthermore, the device 1 has a varistor branch 15, wherein the varistor branch 15 is arranged in parallel with the capacitor branch 5 and with the operating current branch 2. A mechanical switch 3 and a power semiconductor switch 12 are arranged in the operating current branch 2, wherein the mechanical switch 3 and the power semiconductor switch 12 are in connected in series. A capacitor 6 is arranged in the capacitor branch 5. A metal-oxide varistor 11 is arranged in the varistor branch 15.

The device 1 furthermore includes an attenuator 7 which is arranged in series with the mechanical switch 3. A bridging switch 9 is arranged in parallel with the attenuator 7, by means of which the attenuator may be bridged. The attenuator 7 includes an inductor element 10 and a resistance element 8, wherein the inductor element 10 and the resistance element 8 are arranged in parallel with one another.

In the present exemplary embodiment, the mechanical switch 3 and the bridging switch 9 are designed as mechanical circuit breakers. The power semiconductor switch 12 is designed in such a way that the device 1 may be used as a bidirectional switch.

The device 1 furthermore includes a protective switch 4 which is configured to interrupt the current flow in the operating current branch 2.

During normal operation of the device 1, a load current flows in the operating current branch 2 via the protective switch 4, the mechanical switch 3, the power semiconductor switch 12, and the bridging switch 9. In the event of a fault, a corresponding current increase occurs in the operating current branch 2. In the event of such a fault, a control unit which is not depicted in FIG. 1 drives the mechanical switch 3 and the power semiconductor switch 12 to switch off. The power semiconductor switch 12 is accordingly blocked and the mechanical switch 3 is opened. Thus, the current from the operating current branch to the capacitor branch 5 is commutated. In addition, the protective switch 4 is also opened, in which case the current initially continues to flow through the capacitor. The capacitor 6 is charged until a voltage drops across the capacitor 6 which is greater than the network voltage. The maximum voltage to which the capacitor 6 is charged is defined via the discharging varistor 11. As a result, the current flowing through the device 1 is forced to zero, whereby a possible arc in the protective switch 4 is extinguished. After such a disconnection of the device 1, the capacitor 6 is charged to approximately twice the nominal voltage. If the device 1 is now to be reconnected within a short period of time, the energy stored in the capacitor must initially be released.

As soon as the current in the mechanical switch 3 and thus in the overall operating current branch is zero, the bridging switch 9 may be opened. If the disconnection process of the device 1 is terminated by extinguishing the arc in the protective switch 4, the switches 3, 12 may again be closed. A circuit via which the capacitor 6 may be discharged now closes via the mechanical switch 3, which is now closed, the power semiconductor switch 12, the attenuator 7, and the capacitor 6. The inductor element 10 and the resistance element 8 of the attenuator 7 ensure a limitation of the peak value of the discharge current and absorption of the stored energy of the capacitor 6. As soon as the capacitor 6 is discharged, the bridging switch 9 may be closed again. The circuit is thus ready for the reconnection of the device 1. The connection of the device 1 takes place by closing the protective switch 4.

Figure 2:
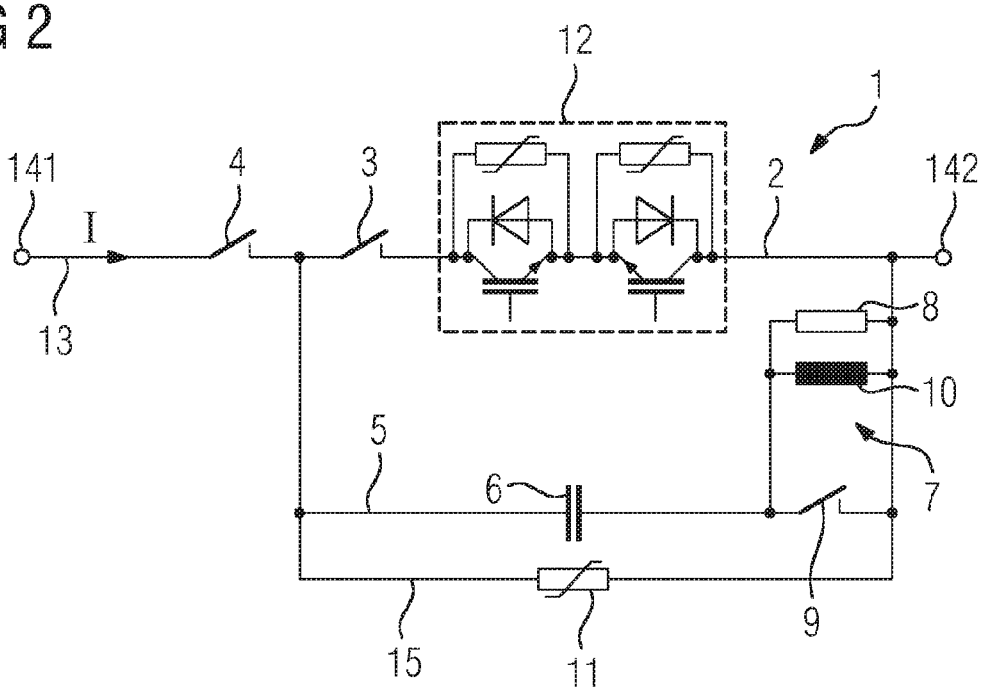
FIG. 2 shows a schematic representation of a second exemplary embodiment of the device according to the present invention.

FIG. 2 schematically depicts a second exemplary embodiment of the device 1 according to the present invention. Similar elements in FIGS. 1 and 2 are provided with identical reference numerals. To avoid repetition, in the following description of FIG. 2, only those elements which differentiate the exemplary embodiment of FIG. 2 from the exemplary embodiment of FIG. 1 are therefore discussed.

In the exemplary embodiment of the device 1 depicted in FIG. 2, the attenuator 7 is arranged in the capacitor branch 5 in series with the capacitor 6. The bridging switch 9 is connected in parallel with the attenuator 7, wherein the attenuator 7 may be bridged by means of the bridging switch 9.

The functionality of the device 1 according to FIG. 2 essentially corresponds to the functionality of the device 1 of FIG. 1.

During normal operation, a load current flows in the operating current branch 2 via the protective switch 4, the mechanical switch 3, and the half-power switch 12. In the event of a fault, a corresponding current increase occurs in the operating current branch 2. In the event of such a fault, a control unit which is not depicted in FIG. 2 drives the mechanical switch 3 and the power semiconductor switch 12 to switch off. The power semiconductor switch 12 is accordingly blocked and the mechanical switch 3 is opened. In addition, the protective switch 4 is also opened. In this way, the current from the operating current branch to the capacitor branch is commutated. The capacitor 6 is charged until a voltage drops across the capacitor which is greater than the network voltage. The maximum voltage to which the capacitor 6 is charged is defined via the discharging varistor 11. As a result, the current flowing through the device 1 is forced to zero, whereby a possible arc in the protective switch 4 is extinguished. After such a disconnection of the device 1, the capacitor 6 is charged to approximately twice the nominal voltage. If the device 1 is now to be reconnected within a short period of time, the energy stored in the capacitor must initially be released.

As soon as the current in the mechanical switch 3 is zero, and if the disconnection process of the device 1 is terminated by extinguishing the arc in the protective switch 4, the bridging switch 9 may be opened. Furthermore, the switches 3, 12 may be closed again. A circuit via which the capacitor 6 may be discharged now closes via the mechanical switch 3, the power semiconductor switch 12, the attenuator 7, and the capacitor 6. The inductor element 10 and the resistance element 8 of the attenuator 7 ensure a limitation of the peak value of the discharge current and absorption of the stored energy of the capacitor 6. As soon as the capacitor 6 is discharged, the bridging switch 9 may be closed again. The circuit is thus ready for the reconnection of the device 1. The connection of the device 1 takes place by closing the protective switch 4.

LIST OF REFERENCE NUMERALS

1 Device for switching a direct current
2 Operating current branch
3 Mechanical switch
4 Protective switch
5 Capacitor branch
6 Capacitor
7 Attenuator
8 Resistance element
9 Bridging switch
10 Inductor element
11 Varistor
12 Power semiconductor switch
13 Direction arrow
141 Terminal
142 Terminal
15 Varistor branch

The invention claimed is:

1. A device for switching a direct current, comprising:
an operating current branch;
a mechanical switch disposed in said operating current branch;
a protective switch connected to said operating current branch for interrupting a current flow in said operating current branch;
a capacitor branch disposed in parallel with said operating current branch;
a capacitor disposed in said capacitor branch;
an attenuator having a resistance element, said attenuator is disposed one of:
in said capacitor branch and in series with said capacitor; or
in said operating current branch in series with said mechanical switch; and
a bridging switch, said attenuator being bridgeable by means of said bridging switch disposed in parallel with said attenuator.

2. The device according to claim 1, wherein said resistance element has an electric resistance and an inductance whose values are measured such that a discharge time of a discharge of said capacitor via said attenuator is between 50 ms and 500 ms.

3. The device according to claim 1, wherein said attenuator includes a parallel circuit made up of said resistance element and an inductor element.

4. The device according to claim 1, further comprising a varistor disposed in parallel with said operating current branch and said capacitor branch.

5. The device according to claim 1, further comprising a power semiconductor switch disposed in series with said mechanical switch in said operating current branch.

6. The device according to claim 1, wherein said capacitor has a capacitance value between 25 μF and 200 μF.

7. The device according to claim 1, wherein said bridging switch is a mechanical circuit breaker.

8. The device according to claim 1, wherein said bridging switch is an electronic power switch.

9. The device according to claim 1, wherein said resistance element has an electric resistance and an inductance whose values are measured such that a discharge time of a discharge of said capacitor via said attenuator is between 100 ms and 250 ms.

10. A method for switching a direct current, which comprises the steps of:
providing a device having a mechanical switch, an operating current branch in which the mechanical switch is disposed, a protective switch connected to the operating current branch for interrupting a current flow in the operating current branch, a capacitor branch disposed in parallel with the operating current branch, a capacitor disposed in the capacitor branch, and an attenuator having a resistance element, the attenuator is disposed one of in the capacitor branch in series with said capacitor or in the operating current branch in series with the mechanical switch, the device further having a bridging switch, the attenuator being bridgeable by means of the bridging switch disposed in parallel with the attenuator; and
during a fault, after opening the protective switch, opening the bridging switch and the capacitor is discharged via the operating current branch and the attenuator.

11. The method according to claim 10, which further comprises closing the bridging switch after discharging the capacitor and after closing the protective switch.

* * * * *